United States Patent [19]

Zimmerman

[11] 4,081,092

[45] * Mar. 28, 1978

[54] TRACTOR WITH LIFTING MECHANISM FOR MOUNTING A BULLDOZER BLADE OR THE LIKE

[76] Inventor: Emil F. Zimmerman, Richardton, N. Dak. 58652

[ * ] Notice: The portion of the term of this patent subsequent to Mar. 11, 1992, has been disclaimed.

[21] Appl. No.: 623,635

[22] Filed: Oct. 17, 1975

[51] Int. Cl.[2] ..... E02F 3/72

[52] U.S. Cl. ..... 214/131 R; 172/805

[58] Field of Search ..... 214/131 R, 131 A, 768, 214/146 R; 172/803, 804, 805, 807, 808, 809

[56] References Cited

U.S. PATENT DOCUMENTS

| | | | |
|---|---|---|---|
| 2,488,695 | 11/1949 | Upton | 214/131 |
| 2,565,337 | 8/1951 | Allan | 37/144 |
| 2,629,946 | 3/1953 | Ewers et al. | 172/804 |
| 2,904,910 | 9/1959 | Armington | 172/805 |
| 3,209,474 | 10/1965 | Artman | 214/146 R |
| 3,773,116 | 11/1973 | Coontz | 172/804 |
| 3,870,171 | 3/1975 | Zimmerman | 214/131 R |

*Primary Examiner*—Drayton E. Hoffman
*Assistant Examiner*—Ross Weaver
*Attorney, Agent, or Firm*—H. Dale Palmatier

[57] ABSTRACT

A tractor is provided on either side with elongated lifting beams pivotally joined rearwardly to the tractor frame and including at least one cross member joining the beams forwardly of the tractor and to which a bulldozer blade or other implement may be attached. A pivot member is attached pivotally to the tractor frame generally beneath and intermediate the length of the beam. A frame-mounted hydraulic jack is coupled to the pivot member at a point spaced from the mount of the latter to the frame and is oriented to urge the pivot member to pivot upwardly and forwardly. A beam strut, pivotally connected at one end to the beam and at the other end to the pivot member at a point spaced from the mounting of the latter to the frame, is oriented to form a generally forwardly open angle with a line passing between its attachment to the pivot member and the mount of the pivot member to the tractor frame. The moment arm extending between the mount of the pivot member to the frame and the attachment to the hydraulic cylinder is longer than the moment arm passing between the pivotal attachments of the pivot member to the frame and to the beam strut, whereby significant mechanical advantage is obtained in raising the lifting beams. Also disclosed is a bulldozer blade having rearwardly extending, vertically spaced mounting plates which are mounted by means of at least one vertical pin to vertically spaced brackets forming part of the front structure of the lifting arms and cross member. Further disclosed is a forwardly open bucket having side and bottom walls abutting the forward surface of the bulldozer blade and pivotally attached to the blade to permit the bucket to move in an upward, forward arc to discharge its contents.

9 Claims, 10 Drawing Figures

TRACTOR WITH LIFTING MECHANISM FOR MOUNTING A BULLDOZER BLADE OR THE LIKE

BACKGROUND OF THE INVENTION

In the agricultural industry, many varied uses are made of farm tractors for transporting various farm implements across a field. The tractor is often the most powerful and versatile piece of equipment employed on most farms. Many farmers have the need, however, of an earth-moving tool such as a bulldozer for clearing fields, shoveling snow, transporting grain or other feed, and the like. The expense of purchasing and maintaining a bulldozer, however, often proves to be economically unfeasible. It has long been desired to provide an attachment to ordinary farm tractors whereby such tractors could perform light earth-moving duties, and a number of bulldozer blade attachments have been suggested, one of which is described in my U.S. Pat. No. 3,870,171.

To the best of my knowledge, none of the attachable bulldozer blade devices of the prior art have been particularly successful. Problems have arisen, for example, with the manner in which the blade may be moved up and down, with the rigidity of the attachment of the blade to the tractor, and particularly with the effort required to mount a bulldozer blade to a tractor. Desirably, attachment of the blade to a tractor should be accomplished easily and quickly by one man, the blade should be positionable at an angle to the direction of travel of the tractor to permit snow plowing and the like, and the blade should be capable of being raised a considerable distance above the ground as when snow or other material is to be placed in a pile or loaded into a truck or the like. The tractor and its attachable blade should be of rugged, and yet simple, construction so as to increase reliability and reduce the likelihood of damage requiring extensive repairs.

BRIEF SUMMARY OF THE INVENTION

The invention relates to a tractor equipped with a hydraulic lifting device extending forwardly of the tractor and to which may be readily attached a bulldozer blade or the like. The tractor includes a pair of elongated lifting beams disposed longitudinally of the tractor on either side thereof and pivotally mounted at their rearward ends to the tractor frame. The lifting beams are joined forwardly of the tractor by structure including at least one transverse bar, with the forward structure being adapted for attachment, for example, to a bulldozer blade. Hydraulic lifting means are provided to pivot the beams upwardly and downwardly about their pivotal attachments to the frame. The lifting means includes, for each beam, an elongated pivot member pivotally mounted to the tractor frame intermediate the length of and adjacent the lifting beam. Hydraulic means, such as a hydraulic cylinder, is coupled to the pivot member at a first point which is spaced from the mounting of the pivot member to the frame, the hydraulic means being oriented to urge the pivot member to pivot upwardly and forwardly. The lifting means includes a beam strut pivotally connected at one end to the beam and at the other end to the pivot member at a second point which is spaced from the mounting of the pivot member to the frame. The first point of the pivot member is spaced further from the mounting thereof to the frame than is the second point, and the beam strut is oriented with respect to the pivot member so that a line between the pivotal end connections of the beam strut forms a generally forwardly open angle with a line passing between the mount of the pivot member to the frame and the second point of the pivot member. The pivot member desirably is in the form of a pivot plate having three pivotal connections thereon forming the vertex and ends of an "L", the connections at the ends of the legs of the "L" being mounted, respectively, to the frame of the tractor and to the hydraulic cylinder, and the connection at the vertex of the "L" mounting one end of the beam strut, the pivot plate being so oriented as to provide a generally downwardly open angle between the axis of the hydraulic cylinder and a line joining the connections at the ends of the legs of the "L".

The forward structure of the lifting beams provides vertically spaced brackets which are rigidly held with respect to the beams. A forwardly concave bulldozer blade is provided with vertically spaced, rearwardly extending mounting plates passing along the brackets. Removable pin means pass through vertically aligned holes in the mounting plates and brackets to mount the blade to the lifting beams. The blade, as described, may swing to the left or right of the direction of travel of the tractor, and auxiliary alignable holes in the blade mounting plates and spaced brackets may be provided to lock the blade in a given orientation with respect to the direction of travel of the tractor. To the bulldozer blade may be attached a bucket having side and bottom walls engageable with the forwardly concave surface of the blade. The bucket is pivotally mounted at its upper end to the blade by means of a removable, transverse pivot pin permitting the bucket to swing outwardly and upwardly from the blade. Hydraulic means, such as a hydraulic cylinder, is provided to pivot the bucket upwardly and outwardly about the transverse pivot pin to empty its contents.

DETAILED DESCRIPTION OF THE PREFERRED EMBODIMENT

Figure 1:
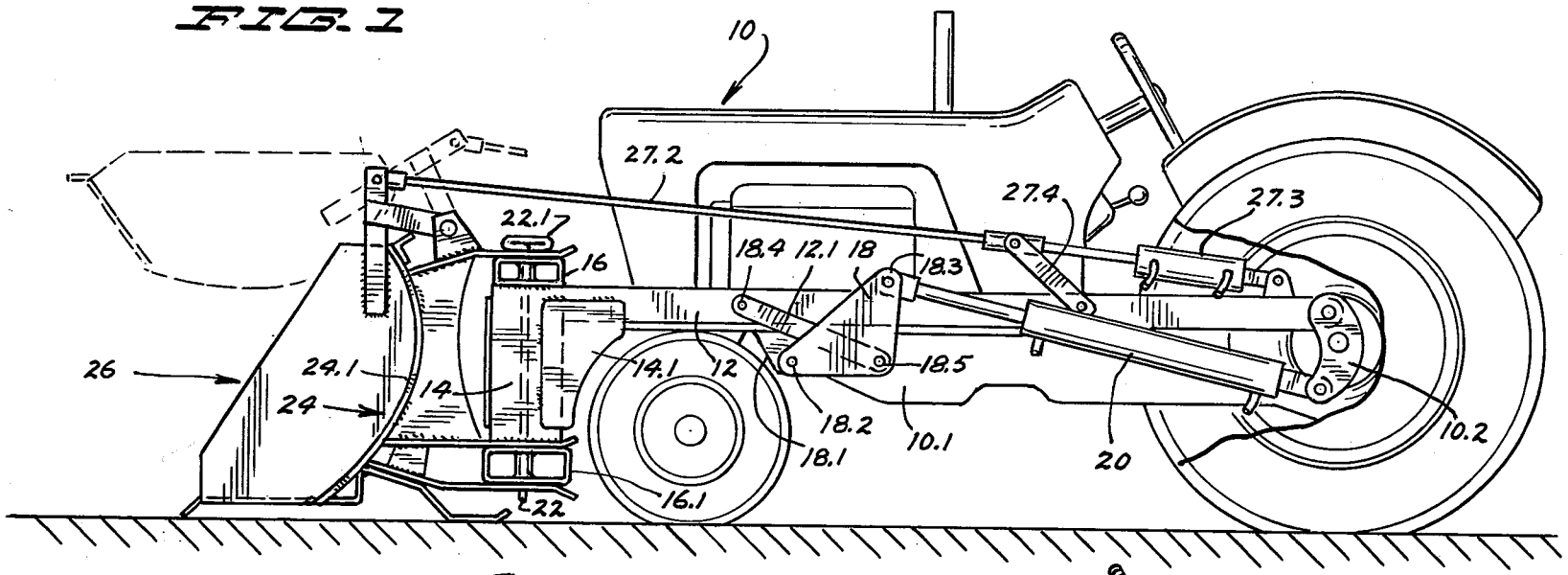
FIG. 1 is a side elevation of a tractor of the invention showing the lifting device in its lower or rest position and showing, in phantom lines, the position of the bucket as it is dumped.
Figure 2:
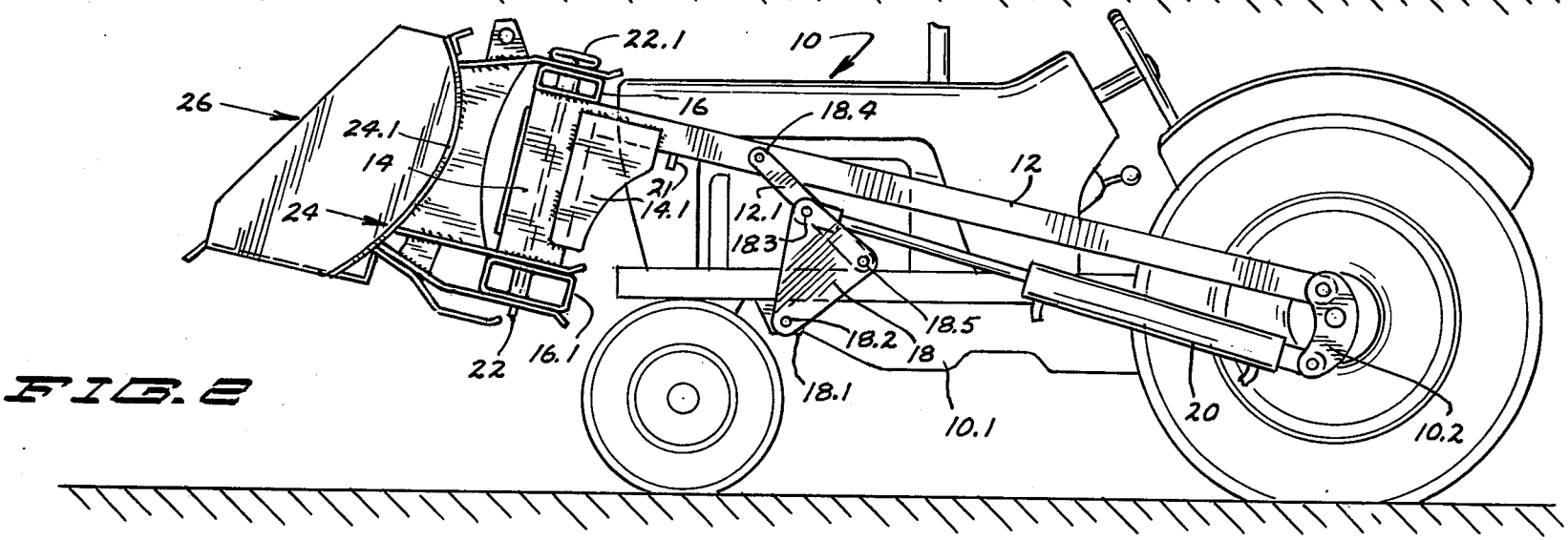
FIG. 2 is a side elevational view similar to that of FIG. 1 but showing the lifting device in its raised position.
Figure 3:
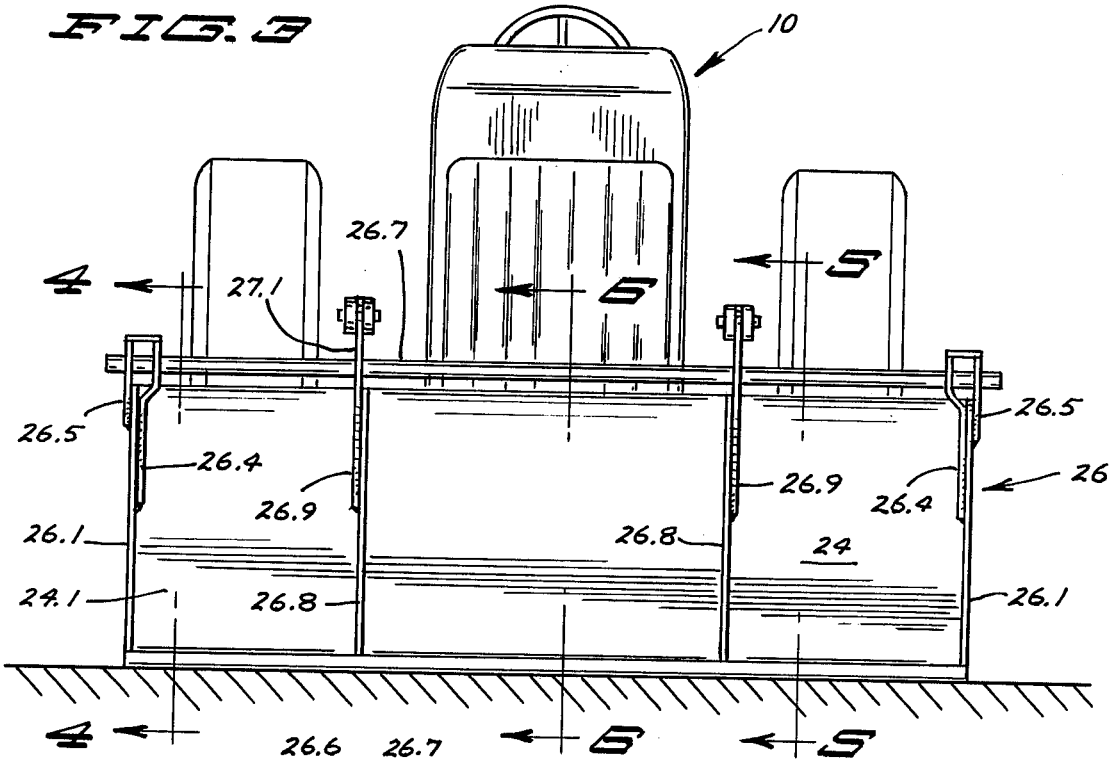
FIG. 3 is a front elevational view of the tractor shown in FIG. 1.

Referring first to FIGS. 1 and 2, a tractor 10, having a frame designated generally as 10.1, is provided at its rearward end with a generally C-shaped, frame-mounted bracket 10.2. A pair of spaced, generally parallel, rugged lifting beams 12 are disposed on either side of the tractor and are pivotally connected at their rearward ends to the tractor frame through the brackets 10.2 so that the lifting beams may swing up and down as shown in FIGS. 1 and 2. The lifting beams 12 extend forwardly beyond the front wheels of the tractor. The beams may have an inverted U-shape in cross section, and are ruggedly built. A pair of vertical beams 14 are joined respectively to the the front ends of the lifting beams 12 by means of side brace plates 14.1, 14.2 which are respectively welded to the lifting beams and vertical beams to rigidly join the pairs of beams together. A pair of transverse, vertically spaced, parallel beams 16, 16.1 are respectively welded or otherwise affixed to the top and bottom ends of the vertical beams 14, the transverse beams joining the lifting beams and vertical beams at either side of the tractor together forwardly of the tractor. The transverse beams 16, 16.1 and vertical beams 14 provide the front structure of the lifting mechanism, and to this front structure may be attached a bulldozer blade or the like as will be subsequently described.

An elongated pivot member, shown as pivot plate 18 in FIGS. 1 and 2, is pivotally mounted at 18.2 to a depending ear 18.1 of the frame and is positioned intermediate the length of the lifting arms 12 and adjacent the lifting arms. Hydraulic means, shown as a hydraulic cylinder 20, is pivotally attached at 18.3 to the pivot plate at a point spaced generally upwardly and rearwardly from the pivotal mounting 18.2 of the plate to the frame, as shown in FIG. 1, so that when the hydraulic cylinder is actuated, the pivot plate 18 will be forced to pivot upwardly and forwardly about its pivotal mount 18.2. A beam strut 12.1 is pivotally mounted at one end to the beam at 18.4, as shown in FIGS. 1 and 2, and extends normally rearwardly and downwardly for pivotal attachment at 18.5 to the pivot plate 18. It will be noted from the drawing that when the lifting beams are in their rest or lower position as shown in FIG. 1, the lifting beam strut 12.1 forms a generally forwardly open angle with an imaginary line joining the pivot points 18.2 and 18.5, thereby forming a toggle arrangement for lifting the beam. Further, the distance separating the pivotal points 18.3 and 18.2 is greater than that separating the points 18.5 and 18.2, that is, the moment arm about the point 18.2 generated by the hydraulic cylinder 20 acts through a greater distance than does the moment arm generated at the point 18.5 about the pivot 18.2. As a result, extension of the hydraulic cylinder 20 causes the lifting beams 12 to be raised with great force. It will further be noted that the pivot point 18.5 is located considerably to the rear of the pivotal mount 18.2, and downward and to the rear of an imaginary line joining the pivot mount 18.2 with the pivot point 18.3 (to the hydraulic cylinder). In this manner, as the hydraulic cylinder 20 initially extends from its position shown in FIG. 1, it has a high force component acting perpendicular to a line drawn between the pivot points 18.2 and 18.3 to cause the pivot plate 18 to pivot counterclockwise about its axis at pivot point 18.2. As a result, great lifting force is applied to the lifting beams 12 even when the cylinder 20 is initially extended.

It will be understood that each side of the tractor is provided with a pivot plate, hydraulic cylinder, and the like, even though but one side of the tractor is shown in the drawing. The hydraulic cylinders are energized from the usual hydraulic system of the tractor, and are operated in unison. The hydraulic cylinders are attached rearwardly to the bottom end of the C-shaped bracket 10.2, and extend forwardly and upwardly along either side of the tractor for pivotal connection of their forward ends at point 18.3 to the pivot plate 18. If desired, the hydraulic cylinders may be instead mounted at their rearward ends to the beams 12 rather than to the tractor frame through the bracket 10.2.

From FIGS. 1 and 2, it will be noted that the pivot plate 18 is generally triangular in shape, and that the pivot points 18.2, 18.5 and 18.3 are arranged generally in the form of an "L", with the pivot point 18.5 being at the vertex of the "L" and the pivot points 18.2 and 18.3 being at the ends of the legs of the "L". Desirably, the legs of the "L" are approximately at right angles to one another. Moreover, when the lifting beams are at rest as shown in FIG. 1, a line passing between the pivot points 18.2 and 18.3 desirably forms a downwardly open angle, which at least approaches a right angle, with the hydraulic cylinder 20. The pivotal connection 18.4 between the forward end of the beam strut 12.1 and the lifting beam 12 is elevated, and desirably spaced forwardly of, the pivot mount 18.2 of the pivot plate to the tractor frame.

Figure 6:
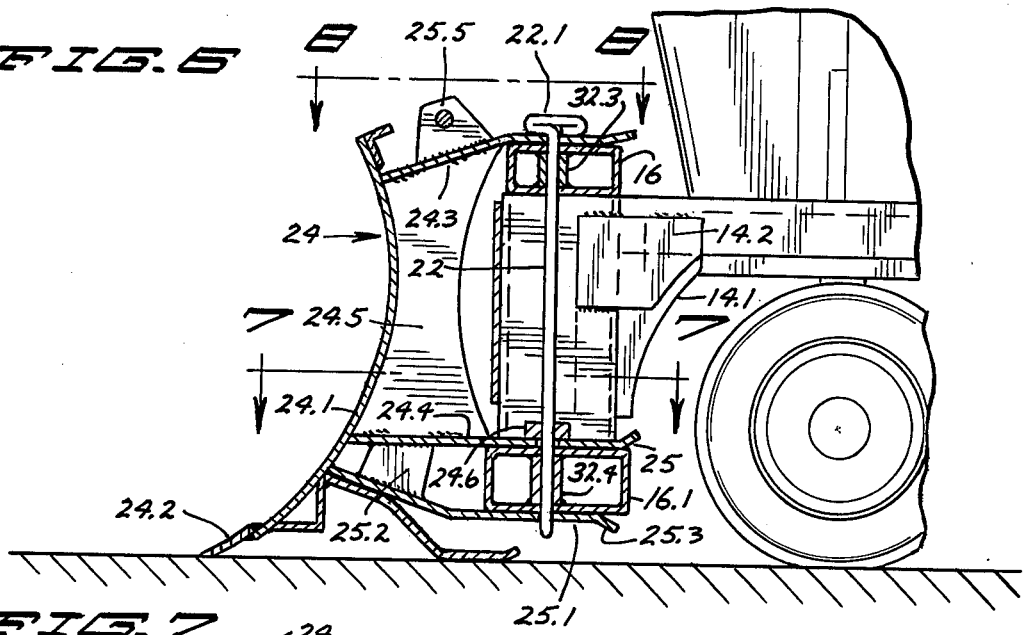
FIG. 6 is a broken away, cross-sectional view taken along line 6—6 of FIG. 3, shown with bucket removed.
Figure 9:
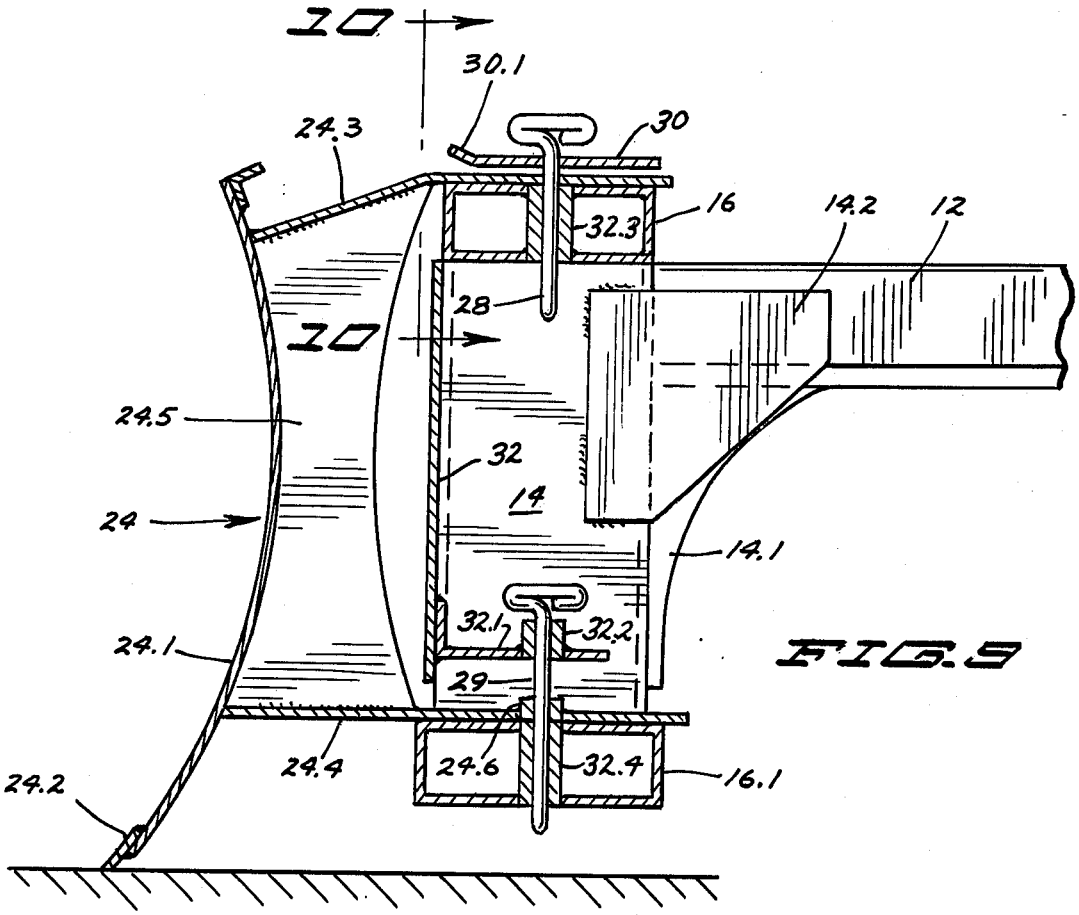
FIG. 9 is a side elevation of a modification of the bulldozer blade and mounting of the invention, shown broken away and in partial cross section.

The transverse beams 16, 16.1 which are ridigly connected to the lifting beams 12, are provided with central, bushed, aligned holes passing therethrough, as shown best in FIGS. 6 and 9. Bronze bushings may be employed. Through the aligned holes in the transverse beams may be inserted a rugged mounting pin 22 having a curved or tapered bottom end for insertion through the holes and having at its upper end a flattened handle 22.1 to permit the pin to be gripped and removed from and/or inserted into the holes. The mounting pin 22, and the transverse beams 16, 16.1 serve to mount a bulldozer blade to the lifting beams 12, as will now be described.

A bulldozer blade is shown generally as 24 in the drawing and includes a forwardly concave blade 24.1 to the bottom edge of which may be affixed a hardened chisel edge 24.2 adapted to scrape the ground. Top and bottom, generally horizontal and rearwardly-extending mounting plates 24.3, 24.4 are welded at their forward ends to the rearward-facing surface of the bulldozer blade, and the mounting plates are further supported by a vertical rigid steel web 24.5 extending between the mounting plates adjacent the blade.

Figure 5:
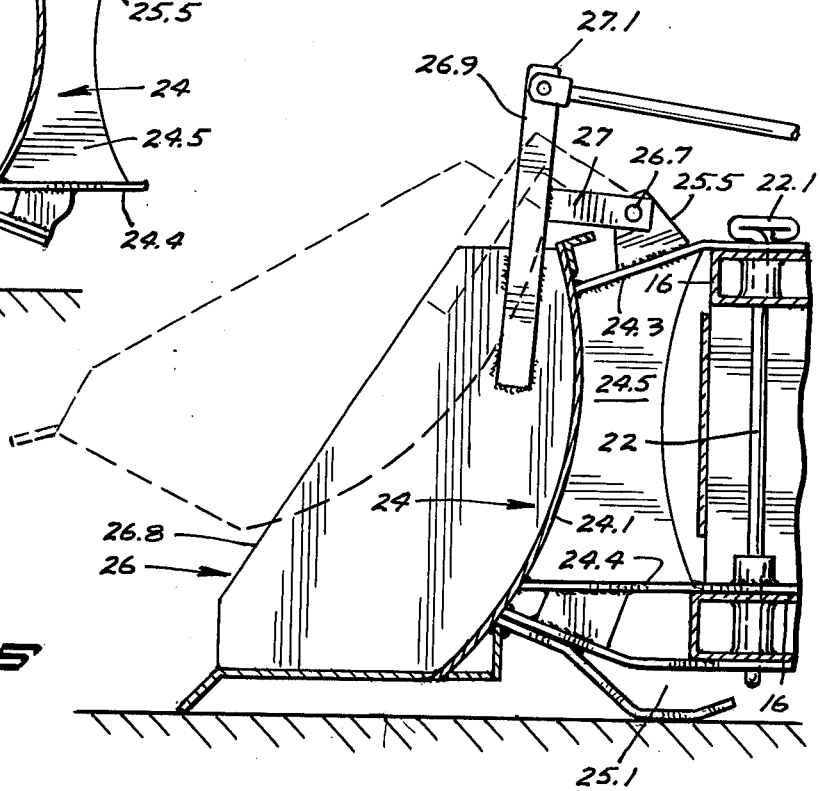
FIG. 5 is a cross-sectional, broken away view taken along line 5—5 of FIG. 3 and showing the bucket in its dumping position.
Figure 7:
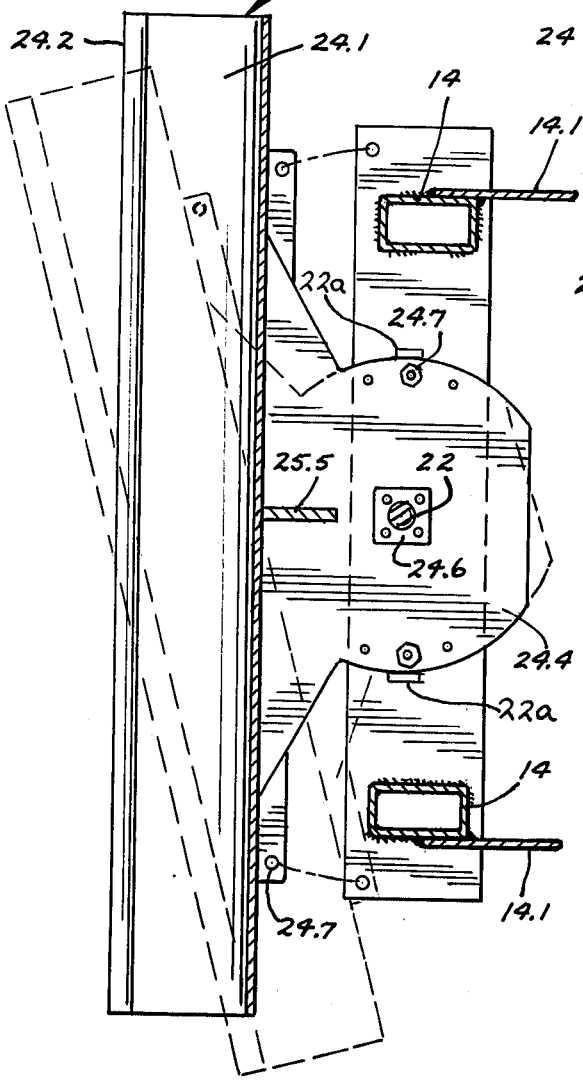
FIG. 7 is a broken away, cross-sectional view taken along line 7—7 of FIG. 6.

As shown perhaps best in FIG. 7, the bottom mounting plate 24.4 is welded to the rear-facing surface of the bulldozer blade 24.1 along a major portion of the width of the blade, and then converges rearwardly into a generally round, disc-shaped bearing plate which is slideably supported on the upper surface of the bottom transverse beam 16.1. The disc-shaped bottom plate 24.4 is provided with a central aperture having a heavy duty bearing 24.6 through which is received the mounting pin 22. Additional apertures 24.7 are spaced about the periphery of the disc-shaped plate 24.4, or at the ends of the plate 24.4 adjacent the blade and are alignable with holes through at least the upper wall of the lower transverse beam 16.1, and locking pins 24.7 are inserted through the aligned apertures and holes in the bottom bearing plate and the lower transverse beam 16.1 to lock the bulldozer blade from pivoting from a chosen position. As shown in FIG. 7, the pivotal support afforded the bulldozer blade by the pin mounting 22, together with the locking pins 24.7, permit the dozer blade to be oriented straight ahead with respect to the direction of movement of the tractor, or to be pivoted to the left or to the right through an angle of, for example, approximately 10°. As shown in FIGS. 5 and 6, the bottom mounting plate 24.4 rests upon the upper surface of the lower transverse beam 16.1.

The top mounting plate 24.3 is also welded to the rear surface of the bulldozer blade across a significant portion of the blade's width, the plate then tapering rearwardly and terminating in a generally rectangular portion 24.8. The latter portion terminates rearwardly in a slightly upturned lip 24.9. The top plate is adapted to slideably engage and ride upon the upper surface of the upper transverse beam 16, as shown in FIGS. 5 and 6. The upturned lip 24.9 at the rear edge of the mounting plate 24.3 eases the mounting plate over the beam 16 to facilitate attachment of the bulldozer blade to the tractor. A similar lip, provided for the same purpose, is provided at the rear-most end of the bottom bearing plate 24.4, and is designated generally as 25. The vertical web 24.5 is welded between the top and bottom plates 24.3 and 24.4 to maintain the proper spacing therebetween and to rigidify the plates with respect to bulldozer blade.

Figure 8:
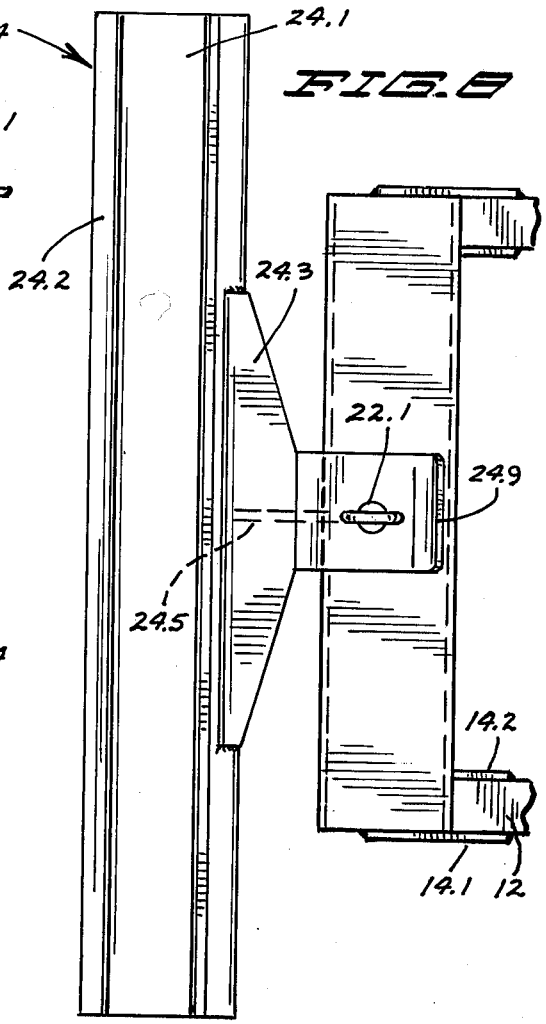
FIG. 8 is a top, broken away view taken along line 8—8 of FIG. 6.

A third mounting plate 25.1, having generally the shape shown in FIG. 8 for the top mounting plate 24.3, is welded to the rearward-facing surface of the bulldozer blade in a position spaced below the lower plate 24.4, and rigidly connected to the latter plate by means of a vertical web 25.2. The rearwardly extending, generally rectangular portion of the third plate is substantially parallel to the disc-shaped portion of the plate 24.4, and the latter plates are spaced vertically a distance approximately equal to the thickness of the bottom transverse beam 16.1. The purpose of the third plate 25.1 is primarily to prevent the other plates 24.3, 24.4 from accidentally being jarred upwardly away from their seating engagement with the upper surfaces of the respective transverse beams 16, 16.1. The third mounting plate 25.1 terminates forwardly in a downturned lip 25.3, the oppositely turned lips 25 and 25.3 coacting to guide between them the lower transverse beam 16.1 when the bulldozer blade is mounted to a tractor, as will be explained in more detail below. The third mounting plate 25.1 is provided with a central aperture in line with the mounting pin 22 to receive the mounting pin therethrough as shown in FIG. 6. A guide shoe 25.4 is carried beneath the third plate and slides along the ground during an earth-scraping operation to correctly position a scraping edge 24.2 of the dozer blade with respect to the ground level.

Figure 4:
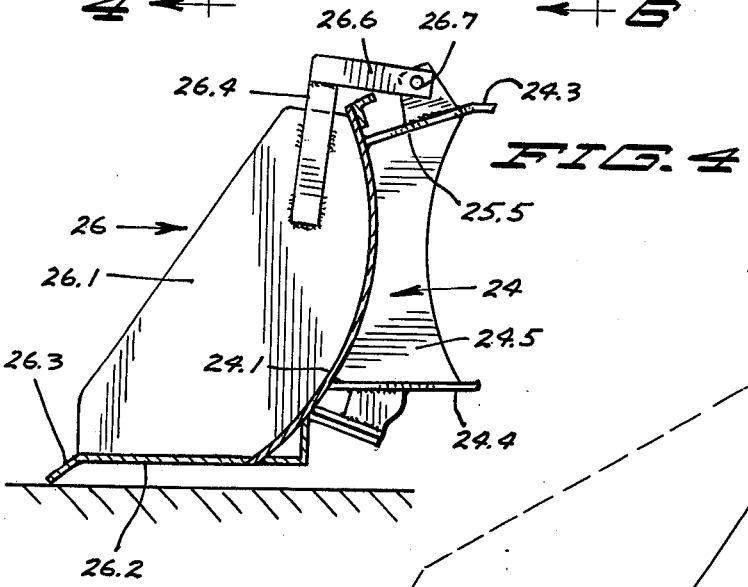
FIG. 4 is a cross-sectional; broken away view taken along line 4—4 of FIG. 3.

To increase the load-carrying capacity of the dozer blade, a bucket attachment is provided. The bucket attachment 26 includes a pair of spaced, upright side walls 26.1 joined at their lower edges to a bottom or floor plate 26.2, the latter plate extending the full width of the dozer blade. The side walls 26.1 have rear edges which are curved to mate with the forwardly concave surface of the bulldozer blade 24.1, and the floor plate 26.2 has a forwardly depending lip 26.3 for scraping the ground. The side walls 26.1 extend upwardly from the forward horizontal edge of the floor plate 26.2 and then angle rearwardly, as shown best in FIG. 4. Welded to the opposed surfaces of the upper ends of the side plates are inner and outer brackets 26.4, 26.5 which extend upwardly above the top edge of the side plates and to which are welded rearwardly extending links 26.6. Arising from the upper surface of the top mounting plate 24.3 are ears 25.5, and the rearward links 26.6 and the ears 25.5 have aligned apertures therethrough which receive a rocker bar designated 26.7 therethrough, the rocker bar extending the entire width of the bulldozer blade 24.1.

Intermediate upright walls, designated generally as 26.8, are spaced along the length of the bulldozer blade and have the same general shape as the end walls 26.1, and are attached, as by welding, to the bottom or floor plate 26.2. Brackets 26.9 are welded to the intermediate walls and extend upwardly over the top of the rocker bar 26.7. Rearwardly extending links 27, which are welded to the brackets 26.9, are attached to the rocker bar 26.7. With reference to FIG. 1, the upper end 27.1 of the brackets 26.9 are pivotally connected to operating rods 27.2 of which each extends rearwardly for connection to the piston of a beam-mounted hydraulic cylinder 27.3. The connection between the operating rod and the piston may be strengthened, if desired, by means of a pivotal link 27.4 which extends between the lifting beam and a sleeve joining the operating rod and piston rod.

From the foregoing, it will be understood that as the piston within the cylinder 27.3 is retracted, the operating rod 27.2 is moved to the rear, thereby causing the bucket 26 to pivot outwardly and upwardly about the axis defined by the rocker bar 26.7. It will further be undertood that the bucket itself has an open rearward end such that when the bucket is tipped to the position shown in phantom lines in FIG. 5, material which had been accumulated in the bucket is released through the open rearward end of the bucket.

If desired, the operating rod 27.2 and hydraulic cylinder 27.3 may be replaced by a small hydraulic cylinder pivotally mounted at its forward end to the upper end 27.1 of the bracket 26.9, and attached to its rearward end rearwardly to the forward structure of the lifting beams to accomplish the same purpose. In this regard, the two intermediate walls 26.8 may be replaced by a single, centrally positioned wall from which rises the bracket 26.9.

Figure 10:
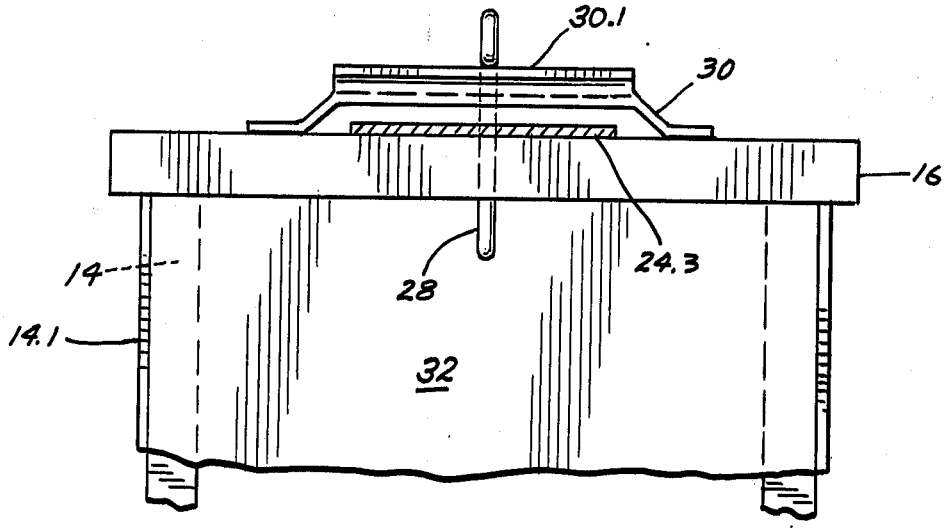
FIG. 10 is a broken away view in partial cross section taken along line 10—10 of FIG. 9.

Referring now to FIGS. 9 and 10, there is shown in FIG. 9 a bulldozer blade attachment in which the single pin 22 of the device of FIGS. 1–8 is replaced with a pair of separate pins 28, 29, the former attaching the top mounting plate 24.3 to the upper transverse beam 16, and the latter attaching the lower mounting plate 23.4 to the beam 16.1. Dual pins, as are used in this embodiment, are particularly appropriate when particularly heavy bulldozer blades or other equipment are to be mounted as the shorter pins may be more easily received within the aligned holes in the plates and beams. In the embodiment of FIGS. 9 and 10, upward movement of the bulldozer blades with respect to the lifting arms is restrained by means of an upper plate 30 which is mounted at its ends to the upper transverse beam 16 and which has a center portion spaced above the beam for reception therebetween of the upper mounting plate 24.3. To facilitate passage of the mounting plate 24.3 between the plate 30 and beams 16, the plate 30 is provided with an upwardly turned leading edge 30.1, as shown in FIG. 9.

As shown particularly in FIGS. 9 and 10, a vertical plate 32 may be welded to the front-facing surfaces of the vertical beams 14 to further rigidify the latter beams. A rearwardly extending horizontal plate 32.1 is welded to the lower end of the vertical plate 32, and has an aperture therethrough provided with a bearing 32.2 aligned with the bearing 32.3 of the upper transverse beam 16 and with the bearing 32.4 of the lower transverse beam 16.1. The lower pin 29 (FIG. 9) passes through the aligned bearings 32.2, 24.6 (of the mounting plates) and 32.4 to rigidly support the lower portion of the bulldozer blade. In FIG. 9, the upper plate 30 which is mounted to the upper surface of the transverse beam 16 is shown spaced above the upper mounting plate 24.3. In practice, the spacing between the upper surface of the transverse beam 16 and the plate 30 should be only such as to permit easy insertion therebetween of the upper mounting plate 24.3 of the bulldozer blade.

From the construction of the bulldozer blade and the bucket, as described above with reference to the drawing, it will be understood that the blade and the bucket are adapted to be easily attached to and detached from the forward structure of the tractor. A convenient stand (not shown) may be provided to store the bulldozer blade in the orientation shown, for example, in FIG. 6 so that the bulldozer blade is maintained in correct position for mounting to the forward structure of a tractor.

In operation, the bulldozer blade of FIGS. 1–8 may be readily attached to a tractor by first positioning the bulldozer blade in the position shown, for example, in FIG. 6, with the aid of a separate stand if necessary. Bulldozer blades of rugged construction ordinarily are too heavy or bulky to be easily handled manually, and it is hence desirable that means be provided to maintain the bulldozer blade in the correct orientation. The tractor, with the lifting beams in their lowered position, is then carefully advanced into the position shown in FIG. 6 with the upper surface of the transverse beam 16 sliding beneath the mounting plate 24.3 and with the lower transverse beam 16.1 being received between the mounting plates 24.4, 25.1. Very slight differences in matching height of the bulldozer blade with the forward structure of the lifting beams may be compensated for by the outwardly turned lips of the mounting plates, designated as 24.9, 25 and 25.3. Some vertical adjustment of the transverse beams 16, 16.1 may be provided by slightly lifting or depressing the lifting beams 12. Auxiliary hydraulic cylinders 21 (FIG. 2) may be mounted to the lifting beams adjacent their forward ends and in position to bear downwardly upon the tractor frame so as to initiate the raising motion of the booms and, more importantly, to provide fine height control for the lifting beams and hence for the bulldozer blade in its ground scraping position.

When the bulldozer blade is in approximately the correct position, as shown in FIG. 6, the pivot pin 22 is inserted from the top and is passed through the bearings in the mounting plates and transverse beams. If desired, suitable stops may be employed to prevent the transverse beams from being inserted too far toward the blade, and other guides **22*a* may be provided, for example, on the upper surface of the lower transverse beam 16.1 at either side of the disc 24.4 to insure side-to-side alignment of the tractor with the blade. No further locking devices should be needed to retain the pin 22** in place; however, if desired, a cotter pin or like device may be inserted through the protruding lower end of the pin to insure that the pin is not accidentally forced upwardly.

In similar fashion, the bulldozer blade shown in FIG. 9 of the drawing may be attached to the tractor. In this embodiment, the pins 28 and 29 may be inserted one after another, the first pin to be inserted preferably being the top pin 28. Insertion of one of the pins provides sufficient alignment as to enable easy insertion of the other pin. The pins 28 and 29 similarly may be provided with cotter pins or like means at their lower ends to prevent them from being accidentally removed.

When the bulldozer blade has been mounted to the tractor, as described above, the blade may be lifted as shown in FIG. 2 for removal from its stand and may then be easily swung to the right or to the left by minimum manual force until the correct angle of attack is attained, following which pins may be inserted through the respective aligned holes 24.7 of the lower mounting plate 24.4, as described above, to lock the bulldozer blade at the correct angle to the tractor.

The bucket 26 may be retained on the bulldozer blade as the latter is attached to the tractor, or may serve as a separate attachment. When emloyed as a separate attachment, the tractor with its mounted bulldozer blade is advanced into contact with the bucket, and the transverse pivot pin 26.7 is then inserted to pivotally connect the bucket to the bulldozer blade. Finally, the connection to the hydraulic cylinders 27.3 is made by simple attachment of the operating rod 27.2 to the upper end 27.1 of the bracket 26.9. As mentioned above, it may be found desirable to employ a single hydraulic cylinder mounted between the bucket and the mounting plate 24.3, rather than the dual cylinders 27.3 of the drawing, in which case the cylinder may remain with the bucket when the latter is detached from the bulldozer blade.

Although the above description of my novel lifting mechanism referred generally to a tractor to which may be mounted a bulldozer blade, it will be understood that the mechanism may be employed as well in other types of machinery, such as in common dump-type trucks or the like in which the bed of the truck is hinged rearwardly to the frame to permit the forward end of the truck bed to swing upwardly. At least one and desirably a pair of lifting beams 12 may form or be attached to the frame of the truck bed and are pivotally attached rearwardly to the truck frame, so that as the beams are swung upwardly, as described above with reference to FIGS. 1 and 2, the truck bed is swung upwardly into a dumping position. The hydraulic cylinders 20 may be pivotally attached rearwardly to the frame of the truck.

Manifestly, I have provided a tractor or other vehicle with a lifting device, and also an easily attachable and detachable bulldozer blade and bucket. The blade and the bucket may be readily attached to the forward structure of the tractor by a single workman, and may be pivoted to the left or to the right and locked into position as desired. The bulldozer blade and bucket have few moving parts and are of simple and rugged construction. The lifting beams at the sides of the tractor are hydraulically elevated by means which has few moving parts and which also places great upward force on the lifting arms even when the lifting arms are initially raised from their lower or rest position.

While I have described a preferred embodiment of the present invention, it should be understood that various changes, adaptations, and modifications may be made therein without departing from the spirit of the invention and the scope of the appended claims.

What is claimed is:

1. A tractor with a hydraulic lifting device extending forwardly therefrom and to which may be readily attached a bulldozer blade or the like, the lifting device including a pair of elongated lifting beams disposed longitudinally of the tractor on either side thereof and pivotally mounted at their rearward ends to the tractor frame, at least one transverse bar joining the lifting beams forwardly of the tractor, and hydraulic lifting means to pivot the beams upwardly and downwardly about their pivotal attachments to the frame between raised and lowered positions, the lifting means including, for each beam, an elongated pivot member pivotally mounted to the tractor frame intermediate the length of and adjacent the lifting beam, hydraulic means coupled to the pivot member at a first point spaced from the mounting of the pivot member to the frame and thereabove and oriented, when the lifting beams are in their rest positions, to urge the pivot member to pivot upwardly and forwardly of the tractor frame, and a beam strut pivotally connected at one end to the beam and at the other end to the pivot member at a second point spaced from the mounting of the pivot member to the frame, the first point of the pivot member being spaced further from the mounting thereof to the frame than is the second point, and the beam strut being so oriented with respect to the pivot member so as to make a generally forwardly open angle with a line passing between the mount of the pivot member to the frame and the second point of the pivot member, whereby as the pivot member is pivoted forwardly and upwardly, the lifting beams are urged upwardly.

2. The tractor and lifting device of claim 1 in which the hydraulic means is a hydraulic cylinder and piston attached rearwardly to the frame and extending forwardly and upwardly for pivotal connection at said first point of the pivot member, the axis of the hydraulic cylinder forming a generally downwardly open angle with a line drawn from the frame mount of the pivot member to the first point thereof.

3. The device of claim 1 wherein the forward structure of the lifting beam includes vertically spaced brackets rigidly affixed to the lifting beams and extending perpendicular thereto and extending therebetween, and further including a forwardly concave bulldozer blade with vertically spaced, rearwardly extending mounting plates interleaving with the brackets and including at least one pin passing through aligned holes in the mounting plates and brackets to mount the bulldozer blade to the tractor.

4. A tractor with a hydraulic lifting device including a pair of elongated lifting beams disposed longitudinally of the tractor on either side thereof and pivotally mounted at their rearward ends to the tractor frame, hydraulic means for swinging the beams upwardly and downwardly about their rearward pivotal connection to the frame, and forward structure rigidly joining the beams forwardly of the tractor and including at least one transverse bar, said forward structure including vertically spaced brackets rigid with respect to the lifting beams; and a forwardly concave bulldozer blade having vertically spaced, rearwardly extending mounting plates interleaving with the brackets, the blade being spaced forwardly of the rigid brackets by a distance having about the same order of magnitude as the spacing between said brackets, and removable pin means passing through vertically aligned holes in the mounting plates and brackets to mount the blade to the lifting beams and to permit the bulldozer to swing to the right or to the left of the direction of travel of the tractor.

5. The tractor and lifting device of claim 4 in which at least one of the mounting plates of the bulldozer blade has a generally flat, downwardly facing surface and wherein at least one of the brackets has a generally flat, upwardly facing surface in sliding supportive contact with the mounting plate to provide a broad, supportive bearing surface between the mounting plate and bracket.

6. The tractor and lifting device of claim 5 including a bucket having side and bottom walls engageable with the forwardly concave surface of the bulldozer blade and being open rearwardly, and a pivot pin pivotally mounting the bucket at its upper end to the blade and so oriented as to permit the bucket to swing outwardly and upwardly from the blade, and hydraulic means for pivoting the bucket with respect to the blade.

7. The tractor and lifting device of claim 6 in which the bucket is provided with upwardly and rearwardly extending brackets, and in which the bulldozer blade is provided with upstanding ears, the brackets and ears having alignable holes therein to receive therethrough a removable pivot pin.

8. The tractor and lifting device of claim 5 in which the forward structure of the lifting arms includes at least a pair of vertically spaced transverse beams having generally flat upper and lower surfaces and defining the brackets, and wherein the mounting plates extending rearwardly of the bulldozer blade include at least two generally parallel plates spaced vertically so as to receive at least one of the transverse beams therebetween.

9. A tractor with lifting device, comprising a pair of elongated lifting beams disposed longitudinally of the tractor on either side thereof and pivotally mounted at their rearward ends to the tractor frame, and hydraulic lifting means including, for each beam, an elongated pivot member pivotally mounted to the tractor frame intermediate the length of and adjacent the lifting beam, a frame-mounted hydraulic cylinder coupled to the pivot member at a first point spaced from the mounting of the pivot member to the frame and oriented to urge the pivot member to pivot upwardly and forwardly as the hydraulic cylinder is extended, and a beam strut pivotally connected at one end to the beam and at the other end to the pivot member at a second point spaced a lesser distance from the mounting of the pivot member to the frame than is the first point, the beam strut being so oriented with respect to the pivotal member so that a line between the pivotal end connections of the beam strut forms a generally forwardly open angle with a line passing between the mount of the pivot member to the frame and said second point, whereby extension of the hydraulic cylinders on either side of the tractor causes the lifting beams to swing upwardly;

mounting means including a pair of transversely spaced vertical beams respectively and rigidly affixed at their upper ends to the lifting beams forwardly of the tractor, and a pair of vertically spaced transverse beams rigidly mounted at their ends to the vertical beams forwardly of the tractor, the horizontal beams defining mounting brackets;

a forwardly concave bulldozer blade having vertically spaced mounting plates extending rearwardly therefrom and interleaving with the transverse beams with flat surfaces of the mounting plates engaging and being supported by flat, upwardly facing surfaces of the respective beams, and removable pin means passing through vertically aligned holes in the mounting plates and transverse beams to mount the blade to the lifting beams and permitting the blade, if otherwise unrestrained, to pivot to the right or to the left of the direction of travel of the tractor, the spacing between the blade and the pin means being a distance of about the same order of magnitude as the vertical spacing between the transverse beams, the mounting plates and beams having auxiliary spaced holes therethrough alignable as the blade is turned to the right or to the left, and auxiliary pins passing through aligned holes to lock the blade at a desired angle with respect to the direction of travel of the tractor.

* * * * *